US010609490B2

(12) United States Patent
Murakami et al.

(10) Patent No.: US 10,609,490 B2
(45) Date of Patent: Mar. 31, 2020

(54) PIEZOELECTRIC SOUNDING COMPONENT

(71) Applicant: Murata Manufacturing Co., Ltd., Nagaokakyo-shi, Kyoto-fu (JP)

(72) Inventors: Junichi Murakami, Nagaokakyo (JP); Masakazu Yamauchi, Nagaokakyo (JP)

(73) Assignee: MURATA MANUFACTURING CO., LTD., Nagaokakyo-shi, Kyoto-fu (JP)

( * ) Notice: Subject to any disclaimer, the term of this patent is extended or adjusted under 35 U.S.C. 154(b) by 0 days.

(21) Appl. No.: 15/982,425

(22) Filed: May 17, 2018

(65) Prior Publication Data

US 2018/0270584 A1 Sep. 20, 2018

Related U.S. Application Data

(63) Continuation of application No. PCT/JP2017/020319, filed on May 31, 2017.

(30) Foreign Application Priority Data

Sep. 28, 2016 (JP) ..... 2016-189748

(51) Int. Cl.
*H04R 17/00* (2006.01)
*G10K 9/122* (2006.01)
(Continued)

(52) U.S. Cl.
CPC ..... *H04R 17/00* (2013.01); *G10K 9/122* (2013.01); *G10K 9/22* (2013.01); *H04R 1/02* (2013.01);
(Continued)

(58) Field of Classification Search
CPC .... H04R 17/00; H04R 1/06; H04R 2307/023; H04R 31/003; H04R 17/005; H04R 17/02;
(Continued)

(56) References Cited

U.S. PATENT DOCUMENTS 6,445,108 B1 * 9/2002 Takeshima ..... B06B 1/0603 310/322
6,570,299 B2 * 5/2003 Takeshima ..... H04R 17/00 29/25.35
(Continued)

FOREIGN PATENT DOCUMENTS

JP 2002330496 A 11/2002
JP 2004015767 A 1/2004
(Continued)

OTHER PUBLICATIONS

International Search Report issued in PCT/JP2017/020319, dated Jul. 11, 2017.
(Continued)

*Primary Examiner* — Fan S Tsang
*Assistant Examiner* — Julie X Dang
(74) *Attorney, Agent, or Firm* — Arent Fox LLP

(57) ABSTRACT

A piezoelectric sounding component includes a diaphragm that includes a metal plate and a piezoelectric body formed on the metal plate. The diaphragm bends and vibrates according to application of voltage to the piezoelectric body. A casing that includes a bottom wall, side walls, and a supporting portion to support the diaphragm in inside edge portions of the side walls. The side walls extending from edges of the bottom wall in a thickness direction and includes a first wall, a second wall positioned to face the first wall, and a third wall positioned between the first wall. Two or more terminals that are formed on the first wall or the third wall serve to apply voltage to the diaphragm. Two or more elastic adhesives join the side walls and the diaphragm between the two or more terminals and the diaphragm. Two or more conductive adhesives are formed on the two or more elastic adhesives and join the two or more terminals and the diaphragm. The diaphragm is supported by the supporting portion and accommodated in the casing so that a gap
(Continued)

formed between the first wall and the diaphragm is smaller than a gap formed between the second wall and the diaphragm.

14 Claims, 7 Drawing Sheets

(51) Int. Cl.

| | |
|---|---|
| ***H04R 1/02*** | (2006.01) |
| ***H04R 7/22*** | (2006.01) |
| ***H04R 7/04*** | (2006.01) |
| ***H04R 7/02*** | (2006.01) |
| ***G10K 9/22*** | (2006.01) |
| ***H04R 31/00*** | (2006.01) |
| ***H04R 1/28*** | (2006.01) |

(52) U.S. Cl.
CPC ..... *H04R 7/02* (2013.01); *H04R 7/04* (2013.01); *H04R 7/22* (2013.01); *H04R 31/00* (2013.01); *H04R 1/2811* (2013.01); *H04R 2201/02* (2013.01)

(58) Field of Classification Search
CPC ..... H04R 1/288; B06B 1/0603; B06B 1/0607; B06B 1/0618; G10K 9/122; G10K 9/121; G10K 9/22; H01L 41/083; H01L 41/0973; A61B 8/44; A61B 8/4444; G06F 1/10
USPC ..... 381/190, 162, 173, 386, 433; 310/322, 310/324, 331, 344
See application file for complete search history.

(56) References Cited

U.S. PATENT DOCUMENTS

| | | | | |
|---|---|---|---|---|
| 6,587,567 | B1 * | 7/2003 | Yamamoto | H04R 1/06 381/190 |
| 6,888,947 | B2 * | 5/2005 | Takeshima | H04R 17/00 310/348 |
| 7,141,919 | B1 * | 11/2006 | Hamada | H04R 17/00 310/348 |
| 2001/0004180 | A1 * | 6/2001 | Kishimoto | H04R 1/06 310/324 |
| 2003/0021458 | A1 * | 1/2003 | Hamada | B06B 1/0603 382/135 |
| 2004/0041497 | A1 | 3/2004 | Hamada et al. | |
| 2004/0124748 | A1 * | 7/2004 | Takeshima | H04R 17/00 310/331 |
| 2007/0108874 | A1 | 5/2007 | Okazaki et al. | |
| 2009/0015108 | A1 * | 1/2009 | Ishimasa | H04R 17/00 310/353 |
| 2014/0169593 | A1 * | 6/2014 | Kwon | H04R 9/043 381/185 |

FOREIGN PATENT DOCUMENTS

| | | | |
|---|---|---|---|
| JP | 2012209866 | A | 10/2012 |
| WO | 2006016443 | A1 | 2/2006 |

OTHER PUBLICATIONS

Written Opinion of the International Searching Authority issued in PCT/JP2017/020319, dated Jul. 11, 2017.

* cited by examiner

PIEZOELECTRIC SOUNDING COMPONENT

CROSS REFERENCE TO RELATED APPLICATIONS

The present application is a continuation of International application No. PCT/JP2017/020319, filed May 31, 2017, which claims priority to Japanese Patent Application No. 2016-189748, filed Sep. 28, 2016, the entire contents of each of which are incorporated herein by reference.

TECHNICAL FIELD

The present invention relates to piezoelectric sounding components.

BACKGROUND ART

In conventional electronic equipment, such as cellular phones and household appliances, piezoelectric sounding components that produce warning sounds and operation sounds, such as piezoelectric speakers and piezoelectric sounders, are widely used.

For example, Japanese Unexamined Patent Application Publication No. 2004-15767 discloses such a piezoelectric sounding component. The piezoelectric sounding component described therein has a structure where a piezoelectric sounding body (diaphragm) constituted of a piezoelectric element, which is ceramic for example, and a metal plate, is accommodated in a casing. The diaphragm accommodated in the casing is fixed to the casing with an elastic adhesive. Further, a conductive adhesive, electrically connected to the piezoelectric element, is formed on top of the elastic adhesive on sides of the diaphragm which face each other.

In the foregoing piezoelectric sounding component the casing is formed so as to be larger than the diaphragm in terms of accommodation and thus a gap is formed between the inside edge of the casing and the peripheral outside edge of the diaphragm. Conductive adhesives are formed on opposing sides of the diaphragm. When the diaphragm is arranged so that the diaphragm is closer to one side of the casing than the other, one of the conductive adhesives needs to be longer than the other. As a result, the longer conductive adhesive receives increased stress applied through the vibration of the diaphragm. Thus, the conductive adhesive can break and is susceptible to improvement in terms of reliability.

The present invention has been made in view of such circumstances and is aimed at providing a piezoelectric sounding component with high reliability.

BRIEF DESCRIPTION OF THE PREFERRED EMBODIMENTS

In accordance with one aspect of the invention, a piezoelectric sounding component includes a diaphragm comprising a metal plate and a piezoelectric body formed on the metal plate. The diaphragm vibrates in response to an application of voltage to the piezoelectric body. The piezoelectric sounding component further includes a casing comprising a bottom wall and first, second and third side walls. The first and second side walls are spaced apart and face one another. The third side wall extends between the first and second side walls. A supporting portion of the casing supports a first peripheral edge portion of the diaphragm at a position corresponding to the first wall, a second peripheral edge portion of the diaphragm at a position corresponding to the second wall, and a third peripheral edge portion of the diaphragm at a position corresponding to the third wall. The area of the first peripheral edge portion of the diaphragm supported by the supporting portion is greater than the area of the third peripheral edge portion of the diaphragm supported by the supporting portion.

The piezoelectric sounding component further includes first and second terminals located on the first and third side walls, respectively, first and second elastic adhesives that join the diaphragm to the casing at locations corresponding to first and second terminals, respectively, and first and second conductive adhesives which extend over the first and second elastic adhesives, respectively, and electrically connect the first and second terminals to the diaphragm, respectively.

In a preferred embodiment, the casing further includes a fourth side wall extending between the first and third side walls, the fourth side wall facing and being spaced from the second side wall. The bottom wall and the first, second, third and fourth side walls cooperate to form a sound chamber having an open end. The supporting portion supports the diaphragm in such a manner that the diaphragm covers the open end of the sound chamber.

In a preferred embodiment, the sound chamber has a rectangular parallelepiped shape.

In an aspect of the invention, the casing includes first, second and third walls located at outer edges of the first, second and third subsections of the supporting portion, respectively. A first gap is formed between the first peripheral edge portion of the diaphragm and the first wall. A second gap is formed between the third peripheral edge portion of the diaphragm. The size of first gap is smaller than the size of the second gap.

In an aspect of the invention, the casing further comprises a fourth side wall which extends between the first and second side walls and is spaced from and faces the third side wall. The area of the second peripheral edge portion of the diaphragm supported by the supporting portion is greater than the area of the fourth peripheral edge portion of the diaphragm supported by the supporting portion.

In a preferred embodiment, the bottom wall and the first, second, third and fourth side walls cooperate to form a sound chamber having an open end.

In another aspect of the invention, the supporting portion supports the diaphragm in such a manner that the diaphragm covers the open end of the sound chamber.

The sound chamber preferably has a rectangular parallelepiped shape.

The present invention can provide a piezoelectric sounding component with high reliability.

DESCRIPTION OF THE PREFERRED EMBODIMENTS

First Embodiment

Embodiments of the present invention are described below with references to the accompanying drawings.

Figure 1:
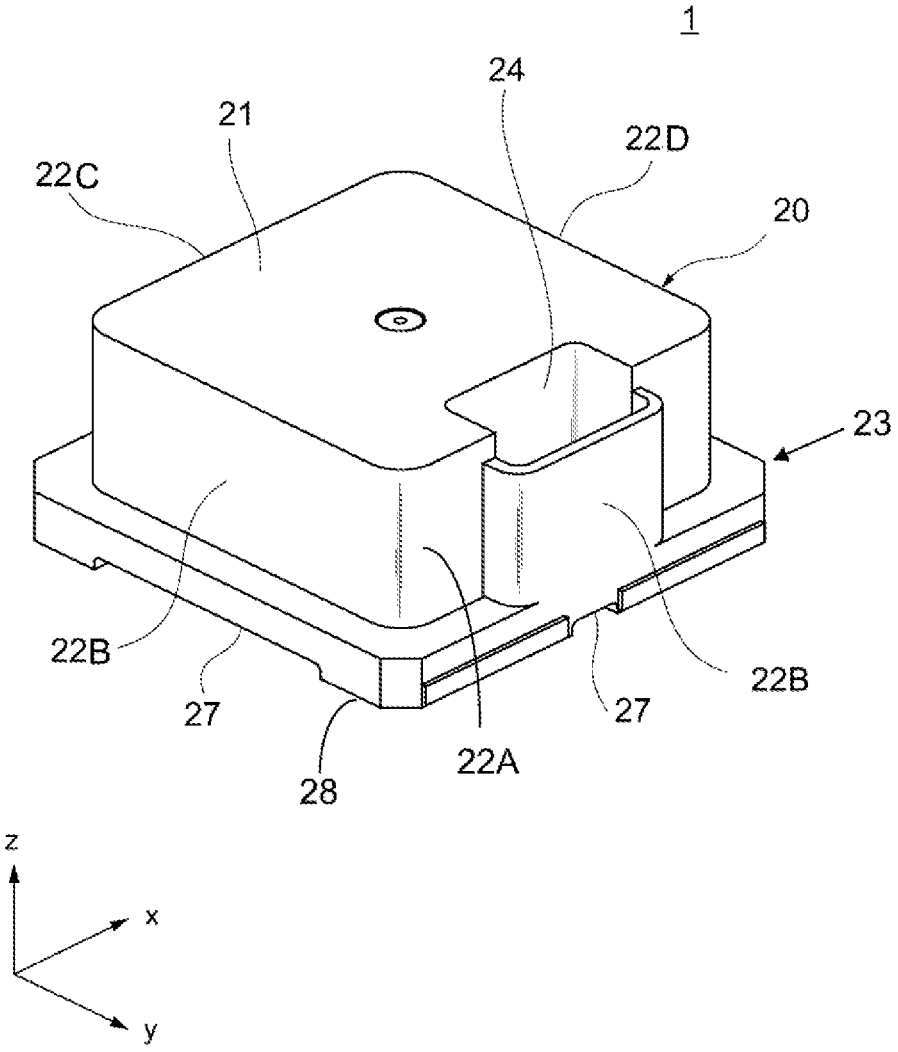
FIG. 1 is a perspective view that schematically illustrates a structure of a piezoelectric sounding component according to a first embodiment.
Figure 2:
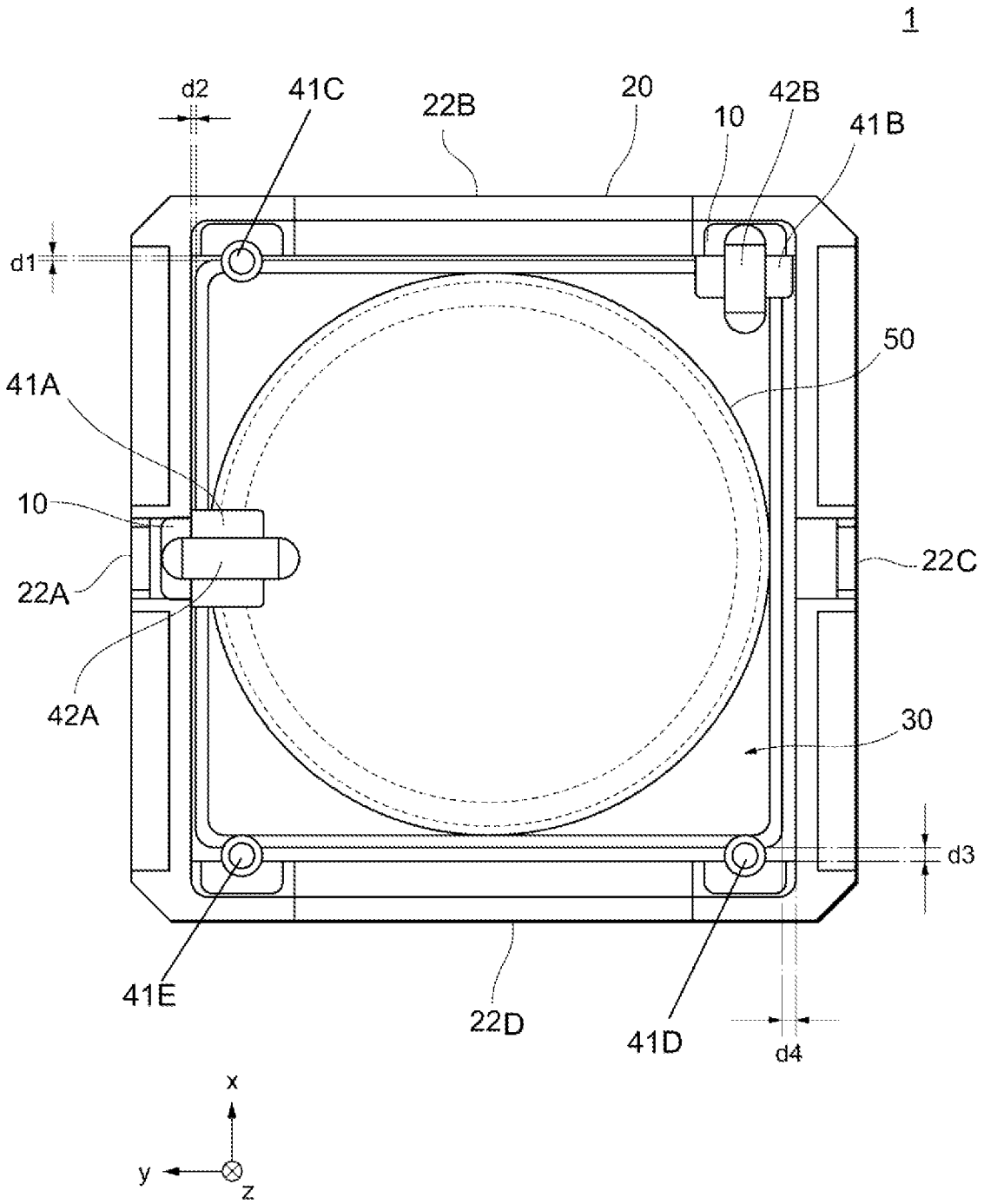
FIG. 2 is a plan view that schematically illustrates a structure of the piezoelectric sounding component according to the first embodiment.
Figure 3:
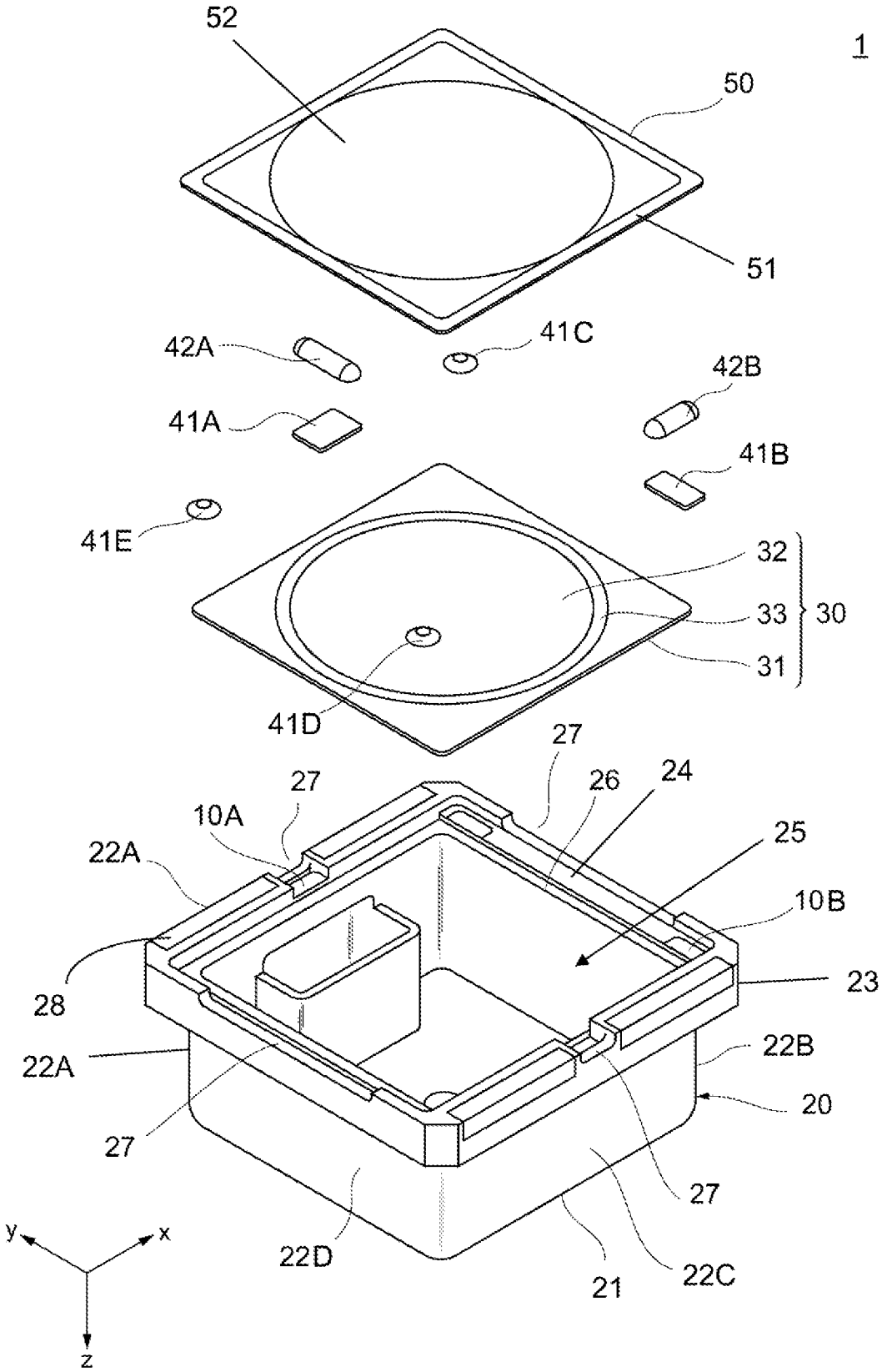
FIG. 3 is an exploded perspective view that schematically illustrates a structure of the piezoelectric sounding component according to the first embodiment.

FIG. 1 is a perspective view that schematically illustrates a structure of a piezoelectric sounding component 1 according to a first embodiment. FIG. 2 is a plan view of the bottom of the piezoelectric sounding component 1. FIG. 3 is an exploded perspective view that schematically illustrates a structure of the piezoelectric sounding component 1. In this view the piezoelectric sounding component is flipped 180° relative to the view in FIG. 1. Although FIGS. 1 to 3 extract and illustrate constituents that are useful in describing at least some of the structural features of the piezoelectric sounding component 1, other components can be included (and some of the illustrated components can be removed).

(1. Structure)

As illustrated in FIGS. 1 to 3, the piezoelectric sounding component 1 includes a casing 20, a diaphragm 30 and a coating portion 50. The piezoelectric sounding component 1 further includes a plurality of elastic insulating adhesives 41A-41E (cumulatively referred to hereinafter as elastic insulating adhesives 41) and conductive adhesives 42A and 42B (cumulatively referred to hereinafter as conductive adhesives 42). The piezoelectric sounding component 1 produces a sound when the diaphragm 30 bends and vibrates as voltage is applied to the terminals 10.

(1-1. Diaphragm)

The diaphragm 30 includes a rectangular flat metal plate 31 (other shapes may be used) and a flat circular piezoelectric body 33 (again, other shapes may be used) is formed on the upper surface of the metal plate (as viewed in FIG. 3). The metal plate 31 is preferably made from a material that has favorable conductivity and spring elasticity, such as a modulus of elasticity of 1 GPa or more, and specifically, is preferably made from a 42 alloy, stainless steel (SUS), brass, phosphor bronze, or the like. For example, the metal plate 31 is a flat plate of a square that has a side of 14.6 mm and a thickness of 0.08 mm approximately. The metal plate 31 may also be from a resin-based material, such as a glass epoxy substrate, only when the modulus of elasticity is 1 GPa or more. The metal plate 31 is not limited to a rectangular shape but may have, for example, a circular shape or a polygonal shape.

In the present embodiment the piezoelectric body 33 is a circular plate that is preferably made from piezoelectric ceramics, such as PZT, and has a radius of approximately 13.6 mm and a thickness (in the Z axis direction) of approximately 0.055 mm. The piezoelectric body 33 is formed approximately in the center of the metal plate 31. The thickness of the piezoelectric body 33 can be set to approximately 20 μm or more and to a few hundred or less according to desired characteristics. The piezoelectric body 33 is not limited to a circular shape but may have, for example, an oval shape or a polygonal shape.

Electrodes 32 which are smaller in diameter than the piezoelectric body 33 are preferably formed on the front and back sides of the piezoelectric body 33. The electrodes 32 may be an Ag baked electrode with a thickness of approximately 1 μm, a NiCu (nickel-copper) alloy with a thickness of approximately 0.2 to 0.4 μm, or an Ag (silver) sputtering electrode.

The diaphragm 30 is accommodated in the casing 20 such that peripheral edge portions of the diaphragm 30 are placed on a supporting portion 26 (described below) and the metal plate 31 faces a bottom wall 21 of the casing 20 (also described below). As best shown in FIG. 2, the diaphragm 30 is accommodated in the casing 20 so as to be closer to regions of side walls 22 of the casing 20 in which the terminals 10A and 10B are formed (these terminals are referred to collectively herein as terminals 10). In the present embodiment, the diaphragm 30 has a structure where the piezoelectric body 33 is formed on part of the metal plate 31, but the invention is not so limited. For example, the diaphragm 30 may have a structure where the piezoelectric body 33 is formed on the entire surface of the metal plate 31. For another example, the diaphragm 30 may be accommodated in the casing 20 so that the piezoelectric body 33 faces the bottom wall 21 of the casing 20. For still another example, the diaphragm 30 may have a structure where the piezoelectric body 33 is formed on both sides of the metal plate 31.

(1-2. Casing)

In this embodiment, casing 20 includes an open sound chamber 25 (FIG. 3) and a frame 23. The open sound chamber 25 is defined by a flat bottom wall 21 lying in an XY plane and four side walls 22A-22D (referred to collectively as side walls 22) extending (upwardly as viewed in FIG. 3 and downwardly as viewed in FIG. 1) at a 90 degree angle relative to the XY plane in which the bottom wall 21 lies. The frame 23 extends (upwardly as viewed in FIG. 3, downwardly as viewed in FIG. 1) from the distal edges of the side walls 20 and terminate in a mounting surface 28 (the topmost surface as viewed in FIG. 3 and the bottommost surface as viewed in FIG. 1) which is typically mounted on a mounting substrate such as a circuit board (not shown). The casing 20 is preferably made of an insulative material, such as ceramics or resin. When the casing 20 is formed of resin, it is preferable to use liquid crystal polymer (LCP), syndiotactic polystyrene (SPS), polyphenylene sulfide (PPS), polybutylene terephthalate (PBT), or the like. The casing 20 is not limited to an approximately squared box shape but may, for example, be shaped like a cylinder or a poligonal prism.

The bottom wall 21 is preferably a flat plate lying in an XY plane. A sound releasing hole 24 (FIG. 1) is formed in the bottom wall 24 to allow a sound produced in the sound chamber 25 by the vibration of the diaphragm 30 to propagate outside the casing 20. In the present embodiment, a depression with a thickness of approximately 1 mm is formed around the sound releasing hole 24.

The side walls 22A-22D (cumulatively referred to hereinafter as side walls 22) extend upwardly (as viewed in FIG. 3) from respective edge portions of the bottom wall 21 in the Z axis direction (that is, in the direction from the bottom wall 21 toward the diaphragm 30) so as to surround a space above the bottom wall 21 and define the sound chamber 25.

The frame 23 is continuous with the upper surfaces of the side walls 22 and extends outwardly and upwardly therefrom (as viewed in FIG. 3). The upper surfaces of the side walls 22 define a supporting portion 26 on which the lower (as viewed in FIG. 3) outer edge surfaces of the diaphragm 30 are supported so as to close the open end of the sound chamber 25. With this structure, the casing 20 supports the diaphragm 30 in a plane which is parallel to the plane of the upper surface of bottom wall 21 and at a position below (as viewed in FIG. 3) the mounting surface such that a space is formed between the upper surface of the diaphragm 30 and the mounting surface 28. One or more slit-like holes 27 are formed in the frame and extend from the space between the upper surface of the diaphragm 30 and the mounting surface 28 and the outside of the casing 20 so as to reduce air resistance in the space.

Due to the presence of the slit-like hole(s) 27, the sound chamber 25, the sound release hole 24 and the space formed between the diaphragm 30 and the mounting substrate, the piezoelectric sounding component 1 can function as a Helmholtz resonator that enhances sound pressure of a specific frequency. The frequency can be adjusted by adjusting the volume (size) of the sound chamber 25, the dimensions and number of holes of the slit-like holes and the sound releasing hole 24.

The outer dimensions of the casing 20 in the present embodiment, may have a length of approximately 18 mm in the X axis direction, a length of approximately 18 mm in the Y axis direction and a thickness of approximately 8 mm in the Z axis direction. The sound releasing hole 24 may have a length along the X axis direction of, for example, approximately 5 mm, a length along the Y axis direction of, for example, approximately 3.5 mm, and a thickness along the Z axis direction of, for example, approximately 3 mm.

(1-3. Terminals)

The terminals 10A and 10B are preferably positioned on two adjoining sides of the frame 23 (sides 22A and 22B in this embodiment). Terminal 10A is formed in the frame 23 at a location near the center of side wall 22A and terminal 10B is formed in the frame 23 at a location near the end portion of the side wall 22B which is located adjacent side wall 22C. The terminals 10 are preferably formed on an upper face (a ledge 24) of the frame 23 corresponding to the height of the upper (as viewed in FIG. 3) main surface of the metal plate 31 to allow the diaphragm 30 to be electrically coupled to a signal source located outside of the casing 20. The terminal is made, for example, by plating with nickel (Ni), copper (Cu), or gold (Au) on iron, brass, or the like. In the present embodiment, the terminals 10 are preferably made of brass (S2680-1/2H), a nickel (Ni) primary coating of 1 μm, and a gold (Au) plating of approximately 0.02 μm or more and 0.1 μm or less. If desired, the terminals 10 may be formed on two non-adjacent sides of the frame 23 or on only on one side of the frame 23. When the casing 20 has a polygonal shape with four or more sides, the terminals 10 are not necessarily desired to be formed on adjacent walls among the side walls 22. In this case, on a wall between the wall where one of the terminals 10 is formed and another wall that faces that wall, the other terminal 10 may be formed.

(2. Adhesion Structure and Accommodation Structure)

An accommodation structure of the diaphragm 30 will be described first.

The diaphragm 30 is supported by the supporting portion 26 so as to be parallel to the XY plane of the bottom wall 21. As best shown in FIG. 2, the diaphragm 30 is accommodated so as to be closer to the side walls 22A and 22B (where the terminals 10A and 10B are formed) than the side walls 22C and 22D. That is, the gaps d1 and d2 between inside edges of the casing 20 and the outer peripheral edges of the diaphragm 30 are smaller than gaps d3 and d4 between inside edges of the casing 20 and the other peripheral edges of the diaphragm 30. Accordingly, the outer peripheral edges of the diaphragm 30 located adjacent side walls 22A and 22B are located closer to the inside edges of the casing 20 than the outer peripheral edges of the diaphragm 30 located adjacent walls 22C and 22D. Since the outer peripheral edges of the diaphragm 30 are supported by the supporting portion 26, the portion of the diaphragm 30 that face the terminals 10 are supported by the supporting portion 26 with an area that is larger than regions that do not face the terminals 10. Consequently, the regions of the diaphragm 30 that face the terminals 10 are reduced in displacement amount through the vibration of the diaphragm 30 compared to the regions that do not face the terminals 10.

An adhesion structure of the diaphragm 30 and the casing 20 is described next.

The diaphragm 30 is coupled to the casing 20 by elastic insulating adhesives 41A-41D (cumulatively referred to hereinafter as elastic insulating adhesives 41). The adhesives 41B-41E are respectively formed at the four corners of the diaphragm 30. Adhesives 41C-41E are circular in shape. Adhesive 41E is rectangular in shape and is located adjacent terminal 10B. Adhesive 41B extends from diaphragm 30 onto the frame 23. Adhesive 41E is also rectangular in shape and is located adjacent terminal 10A. Adhesive 41E extends from diaphragm 30 onto frame 23. The elastic insulating adhesives 41 are preferably lower in elasticity than the conductive adhesive 42 (described below) and the material thereof is for example, a urethane-based adhesive with a modulus of elasticity that is approximately 3.7 MPa or the like.

Two conductive adhesives 42A and 42B (cumulatively referred to hereinafter as conductive adhesives 42) extend from the diaphragm 30 to the terminals 10A and 10B, respectively, and lie over and across the elastic insulating adhesives 41A and 41B, respectively, so as to electrically and physically join the diaphragm 30 and the terminals 10A and 10B, respectively.

As best shown in FIG. 2, the conductive adhesive 42A extends from the vicinity of an approximate center of a side of the diaphragm 30 that faces the side wall 22A to the vicinity of an approximate center of the side wall 22A. In the present embodiment, the piezoelectric body 33 has a shape of a circular plate and is formed in the vicinity of the center of the metal plate 31. Accordingly, the side of the diaphragm 30 that faces the side wall 22A is closest to the piezoelectric body 33 in the vicinity of the center of the side. Thus, forming the conductive adhesive 42A in the vicinity of the center of the diaphragm 30 enables the terminal 10A and the piezoelectric body 33 to be connected through the conductive adhesive 42A short in dimension.

The conductive adhesive 42B extends from the vicinity of an end portion of diaphragm 30 in the region of the diaphragm 30 that faces the side wall 22B to the terminal 10B.

The two conductive adhesives 42A and 42B are preferably formed in the vicinity of the center of its associated elastic insulating adhesives 41A and 41B so as not to stick to the peripheries of the elastic insulating adhesives 41A and 41B, respectively. An example of the material of the conductive adhesives 42 is a urethane-based conductive adhesive with a modulus of elasticity of approximately 0.3 Gpa.

The coating portion 50 is made of a sealing material and includes a sealing portion 51 and a protecting portion 52. In the preferred embodiment, the coating portion 50 covers the entire upper (as viewed in FIG. 3) surface of the diaphragm 30 and also covers the gaps d1-d4 between the outer peripheral edges of the diaphragm 30 and inner surfaces of the casing 20. Thus, the coating portion includes a sealing portion 51 which covers and seals the gaps d1-d4 and a protecting portion 52 which covers and protects the exposed upper surface of the piezoelectric body 33.

Covering the diaphragm 30 with the protecting portion 51 enables the piezoelectric body 33 to be protected even in a structure where the piezoelectric sounding component 1 includes no lid on the mounting substrate side. Accordingly, the number of sub-components that constitute the piezoelectric sounding component 1 can be reduced. Although the coating portion 50 preferably covers the entire upper surface of the diaphragm 30 (as viewed in FIG. 3), the coating portion 50 may cover at least the piezoelectric body 33. In this case, the protecting portion of the coating portion 50 preferably has a shape similar to that of the piezoelectric body 33. For instance, in the example of FIG. 3, the protecting portion has a shape of a circular plate and is in contact with the sealing portion on an extension of the diameter. Further, the protecting portion may have a structure where some or all of the edge portions thereof are in contact with the sealing portion.

The coating portion 50 preferably has a thickness of 500 μm or less. Accordingly, inhibition on the vibration of the diaphragm 30 can be reduced. The coating portion 50 is for example, silicone, epoxy low in elasticity, fluororesin, or the like. When silicone is used for the coating portion 50, the percentage of content of low molecular siloxane is preferably 100 ppm or less. Thus, an insulation fault of ambient electronic components caused by the siloxane separating from the silicone can be inhibited.

As described above, in the piezoelectric sounding component 1 according to the present embodiment, the diaphragm 30 is accommodated in the casing 20 in a state of being closer to the side walls 22 (22A and 22B) where the terminals 10A and 10B are formed. Consequently, the length of the conductive adhesives 42 can be shortened. Further, since the regions of the diaphragm 30 that face the terminals 10 are supported by the supporting portion 26 with an area that is larger than the regions that do not face the terminals 10, the displacement amount through the vibration of the diaphragm 30 can be reduced. That is, the stress applied to the conductive adhesives 42 through the vibration of the diaphragm 30 can be reduced. As a consequence, resistance of the conductive adhesive 42 to vibration can be enhanced and thus, reliability can be increased. Although in the present embodiment, the diaphragm 30 is accommodated in the casing 20 in a state of being closer to the side walls 22A and 22B, even in this case, the displacement amount in the central portion of the diaphragm 30 is not affected. Thus, no decrease is caused in the sound pressure performance of the piezoelectric sounding component 1.

(3. Effect)

By referring to FIGS. 4A, 4B, and FIG. 5, results of verifying effect of the piezoelectric sounding component 1 according to the present embodiment are described below.

Figure 4A:
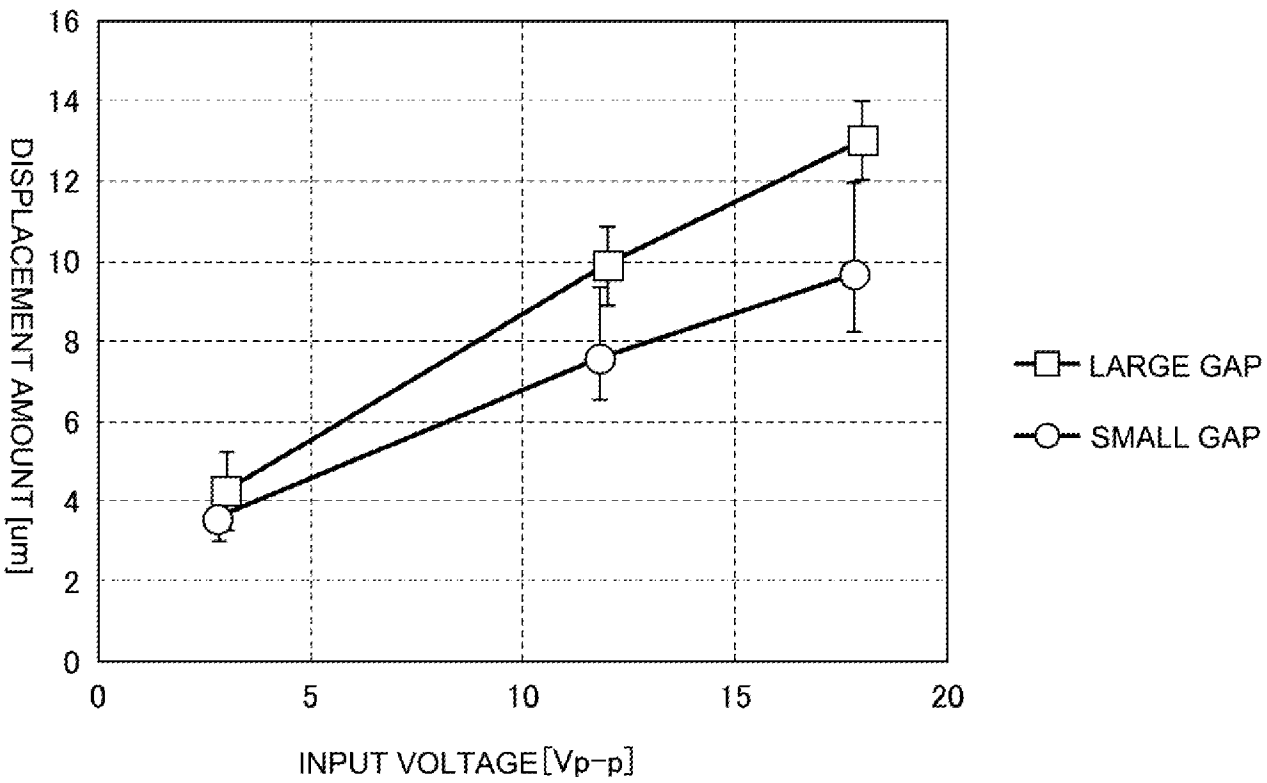
FIG. 4A is a graph that indicates results of verifying effect of the piezoelectric sounding component according to the first embodiment.

FIG. 4A is a graph that indicates results of verifying the relationship between the size of the gaps d1-d4 and the displacement amount of the portion of the diaphragm 30 that is coated with the conductive adhesives 42A and 42B. In FIG. 4A, the vertical axis indicates the displacement amount of the portion coated with the conductive adhesives 42 and the horizontal axis indicates input voltage applied to the terminals 10. The graph line with plotted marks that are rectangles indicates results in a case where the gap is large and the graph line with plotted marks that are circles indicates results in a case where the gap is small.

As demonstrated in FIG. 4A, by causing the gap between the side walls 22 and the diaphragm 30 to be small, the displacement amount in the bending of the diaphragm 30 can be reduced by approximately 16% or more and 25% or less. Specifically, the reduction effect of the displacement amount increases in proportion to the input voltage and when the input voltage is 12 Vp-p, the displacement amount can be reduced by approximately 20% and when the input voltage is 18 Vp-p, the displacement amount can be reduced by approximately 25%.

Figure 4B:
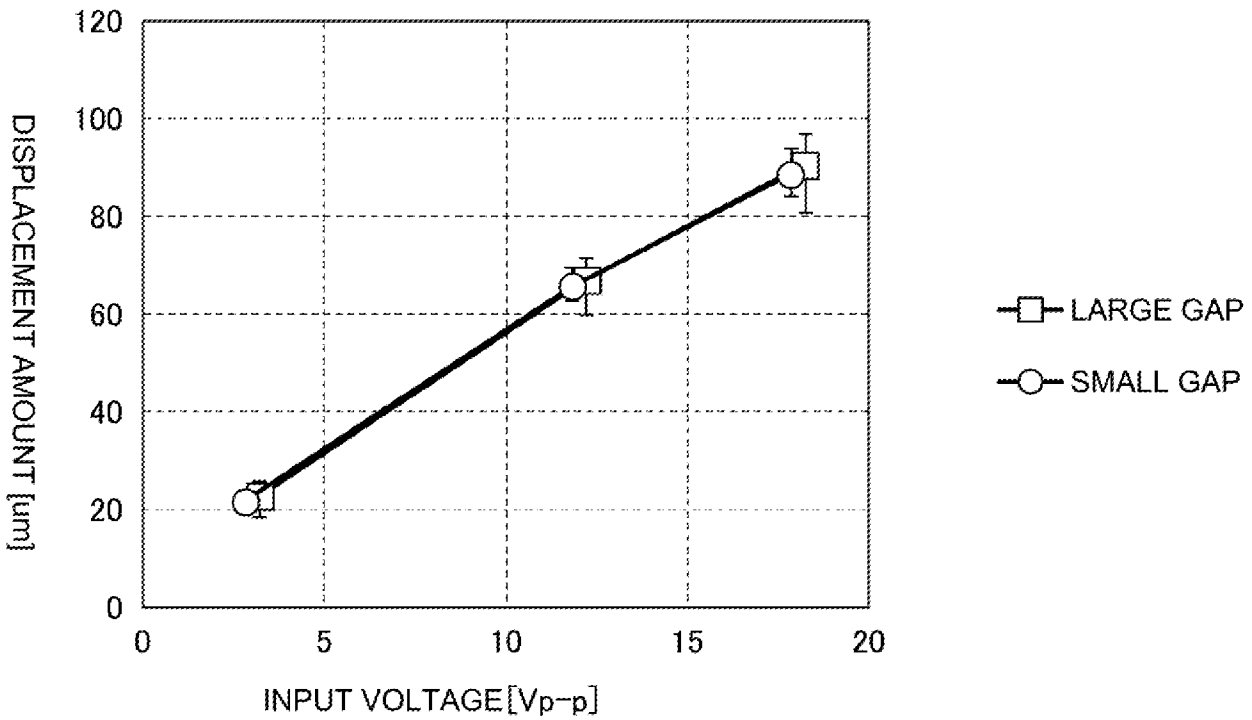
FIG. 4B is a graph that indicates results of verifying effect of the piezoelectric sounding component according to the first embodiment.

FIG. 4B is a graph that indicates results of verifying the relationship between the size of the gap between the side walls 22 and the diaphragm 30 and the displacement amount of the diaphragm in a central portion of the diaphragm 30. In FIG. 4B, the vertical axis indicates the displacement amount in the central portion of the diaphragm 30 and the horizontal axis indicates input voltage applied to the terminals 10. The graph line with plotted marks that are rectangles indicates results in a case where the gap is large and the graph line with plotted marks that are circles indicates results in a case where the gap is small.

As demonstrated in FIG. 4B, the displacement amount in the central portion of the diaphragm 30 increases in proportion to the input voltage regardless of the gap between the side walls 22 and the diaphragm 30. Thus, in the piezoelectric sounding component 1 according to the present embodiment, the displacement amount in the central portion of the diaphragm 30 is not affected and sound pressure performance is not decreased even though the displacement amount in the vicinity of the conductive adhesive 42 is reduced.

Figure 5:
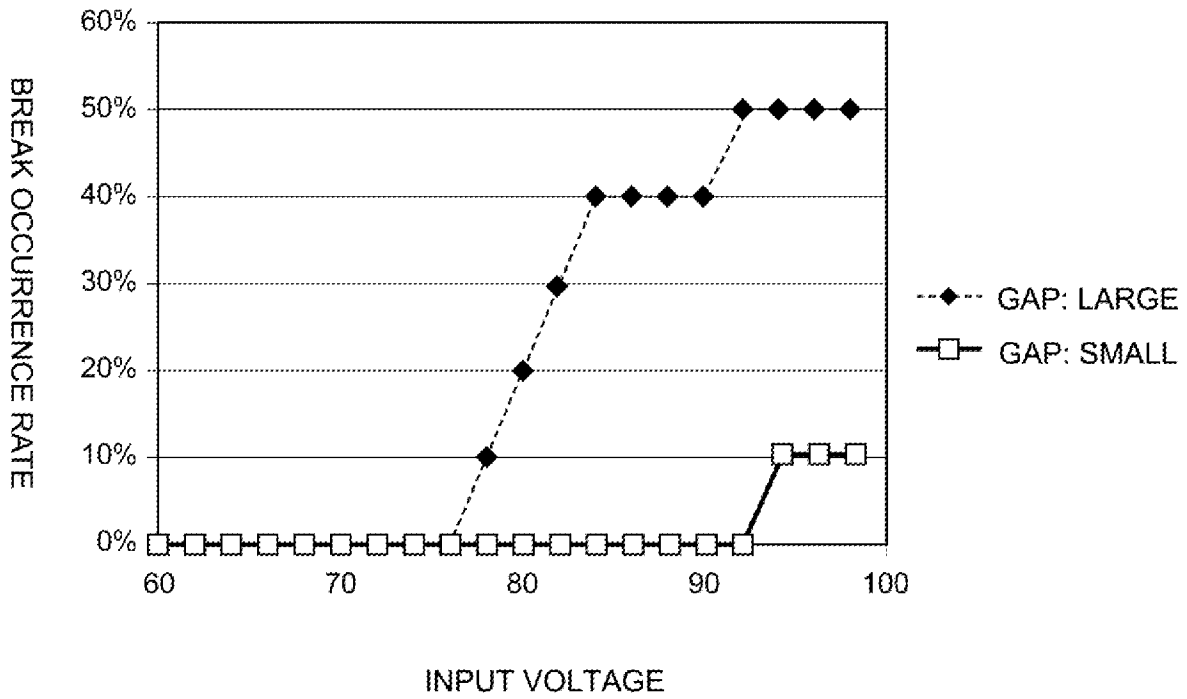
FIG. 5 is a graph that indicates results of verifying effect of the piezoelectric sounding component according to the first embodiment.

FIG. 5 is a graph that indicates results of verifying the relationship between the size of the gap between the side walls 22 and the diaphragm 30 and the occurrence rate of a break in the conductive adhesive 42. In FIG. 5, the vertical axis indicates the break occurrence rate of the conductive adhesive 42 and, similar to FIG. 4, the horizontal axis indicates input voltage. The graph line drawn as the broken line indicates results in a case where the gap is large and the graph line drawn as the solid line indicates results in a case where the gap is small.

As demonstrated in FIG. 5, by causing the gap between the side walls 22 and the diaphragm 30 to be small, the input voltage with which the conductive adhesive 42 starts to break can be raised from 78 Vp-p to 94 Vp-p.

As described above, when the diaphragm 30 is accommodated in the casing 20 in a state of being closer to the side walls 22A and 22B where the terminals 10A and 10B are formed, the displacement amount in the central portion of the diaphragm 30 can be avoided from decreasing while reducing load put on the conductive adhesives 42. Consequently, it is found that sufficient sound pressure performance can be achieved while inhibiting a break in the conductive adhesive 42.

Second Embodiment

In the remaining disclosed embodiments, the descriptions of points in common with the first embodiment are omitted and only different points are described. In particular, similar actions and effects brought by similar structures are not mentioned one by one in each embodiment.

Figure 6:
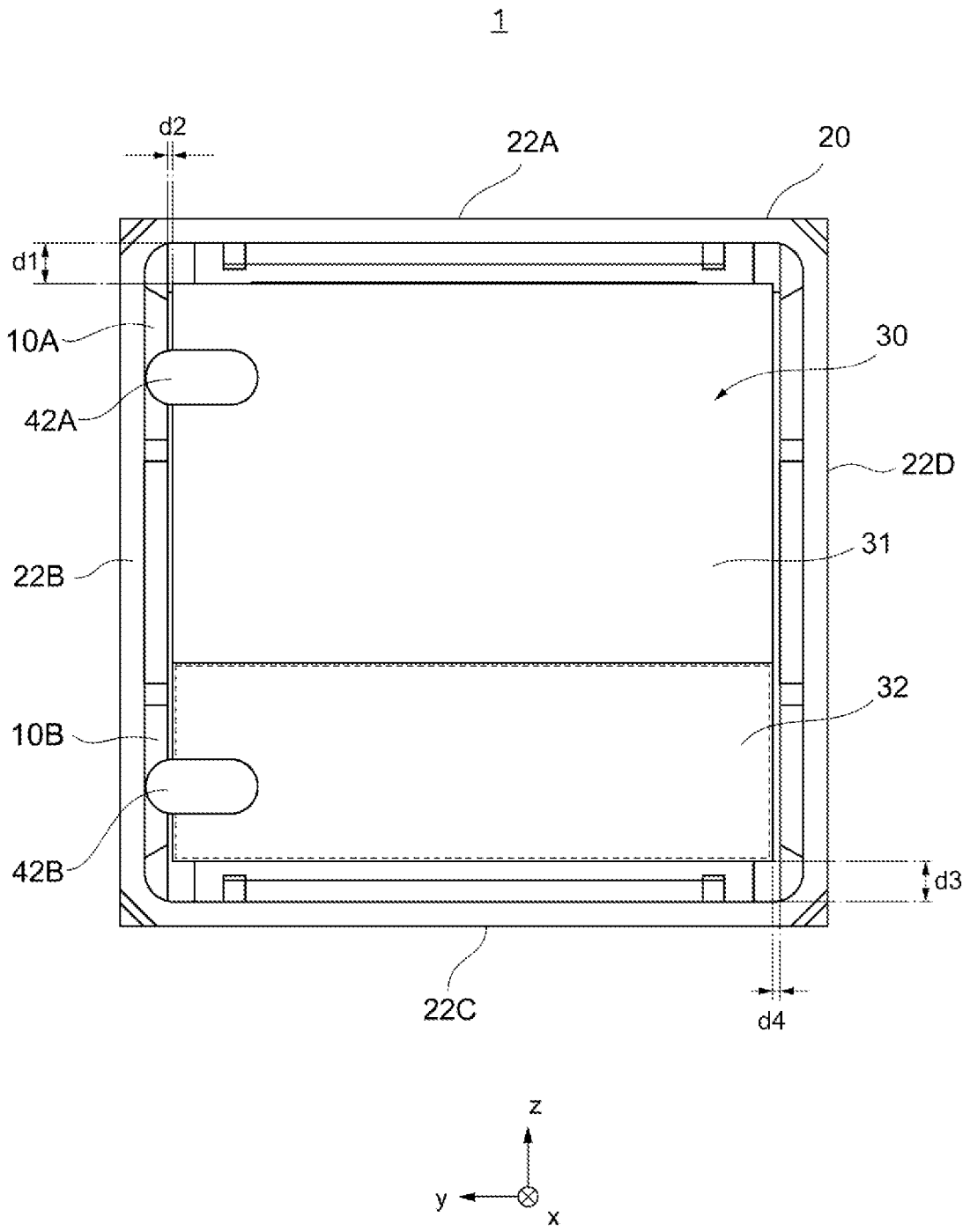
FIG. 6 is a plan view that corresponds to FIG. 2 and schematically illustrates a structure of a piezoelectric sounding component according to a second embodiment.

FIG. 6 is a bottom plan view of a piezoelectric sounding component 1 according to the present embodiment. To simplify the explanation, illustration of the elastic insulating adhesives 41 is omitted in FIG. 6.

In the present embodiment, a piezoelectric body 33 (not illustrated) is a rectangular plate formed between an electrode 32 and a metal plate 31 and having a shape that imitates the electrode 32. The piezoelectric body 33 is formed so as to be closer to the side of the metal plate 31 that faces a side wall 22C. Terminals 10A and 10B are formed near opposite end portions of the side wall 22B. The other constituents of the piezoelectric sounding component 1 are similar to those in the first embodiment.

An accommodation structure and adhesion structure of the diaphragm 30 in the piezoelectric sounding component 1 according to the present embodiment are described next. The diaphragm 30 according to the present embodiment is accommodated in the casing 20 at a location that is closer to the side wall 22B than the side wall 22D. That is, a gap d2 between the outer peripheral edge of the diaphragm 30 and the inside edge of the side wall 22B (more generally the inside edge of the casing 20 located adjacent to the side wall 22B is set so as to be smaller than a gap d4 between the outer peripheral edge of the diaphragm 30 and the inside edge of the side wall 22D (more generally the edge of the casing 20 located adjacent to the side wall 22D). A gap d1 between the outer peripheral edge of the diaphragm 30 and the inside edge of the side wall 22A is set so as to be the same or almost the same as a gap d3 between the diaphragm 30 and the inside edge of the side wall 22C. Conductive adhesives 42A and 42B are formed from respective opposite ends of a region of the diaphragm 30 that face the side wall 22B to respective opposite ends of the side wall 22B (i.e., to terminals 10A and 10B, respectively).

The remaining structure of the piezoelectric sounding component 1 of this embodiment is similar to that of the first embodiment.

Each of the above-described embodiments is intended to facilitate understanding of the present invention and is not intended to limit interpretation of the present invention. The present invention can be changed or modified without departing from its gist and the present invention includes equivalents thereof. That is, what is obtained by a person skilled in the art adding a design change to each embodiment when necessary is subsumed in the scope of the present invention as long as such a change includes the features of the present invention. For example, the elements in each embodiment and the arrangements, materials, conditions, shapes, sizes, and the like thereof are not limited to those exemplified but may be changed when necessary. Each embodiment is an example and, not to mention, partial replacements or combinations in structures described in different embodiments are possible and subsumed in the scope of the present invention as long as such partial replacements or combinations include the features of the present invention.

The invention claimed is:

1. A piezoelectric sounding component, comprising:

(a) a diaphragm having first, second and third peripheral edge portions, the diaphragm comprising:
  (i) a metal plate; and
  (ii) a piezoelectric body formed on the metal plate, the diaphragm being adapted to vibrate in response to an application of voltage to the piezoelectric body;

(b) a casing comprising:
  (i) a bottom wall and first, second and third side walls, the first and second side walls being spaced apart and facing one another and the third side wall extending between the first and second side walls such that the first and third side walls are adjacent one another;
  (ii) a supporting portion which supports the first, second and third peripheral edge portions of the diaphragm at positions corresponding to the first, second and third side walls, respectively, the area of the first peripheral edge portion of the diaphragm supported by the supporting portion being greater than the area of the second peripheral edge portion of the diaphragm supported by the supporting portion;

(c) first and second terminals located on the first and third side walls, respectively;

(d) first and second elastic adhesives that join the diaphragm to the casing at locations corresponding to first and second terminals, respectively; and (e) first and second conductive adhesives which extend over the first and second elastic adhesives, respectively, and which are electrically connect the first and second terminals to the diaphragm, respectively.

2. The piezoelectric sounding component according to claim 1, wherein the casing further includes a fourth side wall extending between the first and second side walls, the fourth side wall facing and being spaced from the third side wall.

3. The piezoelectric sounding component according to claim 2, wherein the bottom wall and the first, second, third and fourth side walls cooperate to form a sound chamber having an open end.

4. The piezoelectric sounding component according to claim 3, wherein the supporting portion supports the diaphragm in such a manner that the diaphragm covers the open end of the sound chamber.

5. The piezoelectric sounding component according to claim 4, wherein the sound chamber has a rectangular parallelepiped shape.

6. The piezoelectric sounding component according to claim 1, wherein:

(a) a first gap is formed between the first peripheral edge portion of the diaphragm and the first side wall; and (b) a second gap is formed between the second peripheral edge portion of the diaphragm and the second side wall, the size of first gap being smaller than the size of the second gap.

7. The piezoelectric sounding component according to claim 1, wherein:

(a) the diaphragm has a fourth peripheral edge portion;

(b) the casing further comprises a fourth side wall which extends between the first and second side walls and is spaced from and faces the third side wall; and (c) the area of the third peripheral edge portion of the diaphragm supported by the supporting portion is greater than the area of the fourth peripheral edge portion of the diaphragm supported by the supporting portion.

8. The piezoelectric sounding component according to claim 7, wherein the bottom wall and the first, second, third and fourth side walls cooperate to form a sound chamber having an open end.

9. The piezoelectric sounding component according to claim 8, wherein the supporting portion supports the diaphragm in such a manner that the diaphragm covers the open end of the sound chamber.

10. The piezoelectric sounding component according to claim 9, wherein the sound chamber has a rectangular parallelepiped shape.

11. The piezoelectric sounding component according to claim 7, wherein:

(a) a first gap is formed between the first peripheral edge portion of the diaphragm and the first side wall;

(b) a second gap is formed between the second peripheral edge portion of the diaphragm and the second side wall, the size of first gap being smaller than the size of the second gap;

(c) a third gap is formed between the third peripheral edge portion of the diaphragm and the third side wall; and (d) a fourth gap is formed between the fourth peripheral edge portion of the diaphragm and the fourth side wall, the size of the third gap being greater than size of the fourth gap.

12. The piezoelectric sounding component according to claim 1, wherein:

(a) the metal plate has a rectangular shape, (b) the piezoelectric body is a circular plate located near a center of the metal plate; and (c) one of the first and second conductive adhesives is formed near a center of the diaphragm.

13. The piezoelectric component according to claim 1, where there is no electrode formed on the second side wall.

14. The piezoelectric component according to claim 7, wherein there are no electrodes formed on the second and fourth side walls.

* * * * *